United States Patent [19]

Barden

[11] 4,051,453

[45] Sept. 27, 1977

[54] VARIABLE RESISTANCE CONTROL WITH LOW NOISE CONTACTOR

[75] Inventor: Wayne A. Barden, Elkhart, Ind.

[73] Assignee: CTS Corporation, Elkhart, Ind.

[21] Appl. No.: 656,184

[22] Filed: Feb. 9, 1976

[51] Int. Cl.[2] ..... H01C 10/32

[52] U.S. Cl. ..... 338/171; 200/11 G; 338/174; 338/202

[58] Field of Search ..... 338/202, 174, 171, 137, 338/118, 160, 162, 169; 200/259, 275, 11 G, 11 K, 11 TW

[56] References Cited

U.S. PATENT DOCUMENTS

| | | | |
|---|---|---|---|
| 1,819,246 | 8/1931 | Jones | 338/171 X |
| 2,853,564 | 9/1958 | Gahagan | 200/11 TW |
| 3,333,068 | 7/1967 | Maskens | 200/11 TW |

*Primary Examiner*—C. L. Albritton
*Attorney, Agent, or Firm*—John J. Gaydos

[57] ABSTRACT

A variable resistance control has a resistance element, a collector, and a low noise contactor wipably engaging the resistance element and the collector. The contactor is provided with a pair of arms and a plurality of fingers extend outwardly from each of the arms. A contact extends from each of the fingers and wipably engages the resistance element. The contacts on one of the arms are spaced apart lengthwise of the resistance element from the contacts on the other arm for reducing contact noise.

9 Claims, 5 Drawing Figures

VARIABLE RESISTANCE CONTROL WITH LOW NOISE CONTACTOR

The present invention relates to a variable resistance control and, more particularly, to a low noise contactor wipably engaging the resistance element of the control.

In a variable resistance control, a movable contactor wipably engages the surface of a resistance element. Even if great care is used in preparing the surface of the resistance element, the surface of the resistance element still exhibits a degree of irregularity or uneveness. During operation of the control and, as the contacts of the contactor wipingly engage the surface of the resistance element, the uneven surface of the resistance element causes contact noise, i.e., irregularities in the output from the contactor. The resistance between a contact and the surface of the resistance element is substantially dependent upon the actual conductive area and the pressure between the contact and the resistance element and usually is defined as contact resistance. The irregularities on the surface of the resistance element cause the conductive area to vary as the contact is moved along the resistance element. When current passes through the contact into the resistance element, the current density between the contact and the resistance element is inversely proportional to the conductive area and directly proportional to the pressure. The instantaneous change in current during movement of the contact along the surface of the resistance element produces contact noise.

It is well known in the art that contact noise can be decreased by increasing the number of contacts on a contactor. Prior art contactors have to a certain degree, decreased contact noise by providing a plurality of contacting fingers such as shown in U.S. Pat. Nos. 3,537,056 and 3,670,285, of common assignee. Each of the fingers is independently flexible and readily follows the minute undulations or irregular contour of the surface of the element unaffected by the adjacent fingers. Such prior art contactors always had the contacts lying in a single plane intersecting the surface of the resistance element. But as the width of the fingers is decreased in response to a need to reduce the size of the contactor for miniaturization or to maximize the number of contacting fingers contacting the resistance element, difficulties are encountered in a reduction of the mechanical strength and durability of the fingers so reduced in size. Additionally, the tooling required to produce such fingers of reduced width becomes increasingly fragile and expensive and exhibits a greatly reduced life. It is, therefore, desirable to produce a variable resistance control having a contactor with a plurality of fingers but wherein the number of fingers of the contactor are in opposing relationship and closely spaced further to minimize contact noise and to overcome the aforementioned problems.

Variable resistance controls having a contactor with resilient fingers or contacts in opposing relationship are well known in the art and are exemplified in controls such as shown in U.S. Pat. No. 3,409,855 and application Ser. No. 530,749 filed on Dec. 12, 1974 issuing as U.S. Pat. No. 3,953,821. Such controls are, however, commonly referred to as fader controls and are commonly employed for changing in the alternative, the volume of a pair of loudspeakers. It has always been considered undesirable to employ a fader control as described in the above mentioned patents for controlling the input of a single loudspeaker because of the large incremental resistance between the opposing contacts. It was, however, discovered that if the contacts are in closely spaced planes intersecting the surface of the resistance element, then the resistance of the element between the contacts becomes minimal and does not affect the operability of the variable resistance control but substantially decreases the contact noise.

Accordingly, it is an object of the present invention to provide a variable resistance control having a contactor with resilient fingers engaging the resistance element in opposing relationship to minimize contact noise. A further object of the present invention is to provide a variable resistance control having a contactor with a plurality of contacts in opposed staggered relationship to minimize contact noise. Yet another object of the present invention is to provide a variable resistance control with a contactor having a plurality of contacts in a pair of closely spaced planes intersecting the surface of the resistance element for reducing contact noise. Further objects and advantages of the present invention will become apparent as the following description proceeds and the features of novelty characterizing the invention will be pointed out with particularity in the claims annexed to and forming a part of this specification.

Briefly, the present invention relates to a variable resistance control having a contactor provided with a plurality of resilient fingers for reducing contact noise. Each of the fingers is provided with a contact wipably engaging a resistance element. The fingers are disposed in opposing relationship and lie in a pair of closely spaced planes defining spaced lines on the resistance element generally transverse to the length thereof. The distance between each of the lines is greater than zero but less than the width of the resistance element or less than ten percent of the length of the resistance element. The total width of the fingers lying in one plane including the spacings therebetween is less than the width of the resistance element, and twice the total width is greater than the width of the resistance element.

For a better understanding of the present invention, reference may be had to the accompanying drawings wherein the same reference numerals have been applied to like parts and wherein.

Figure 1:
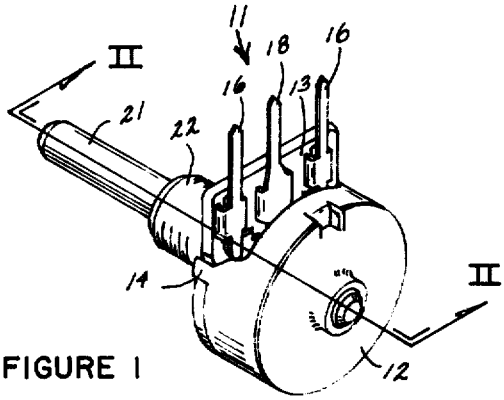
FIG. 1 is an isometric view of the variable resistance control of the present invention.
Figure 2:
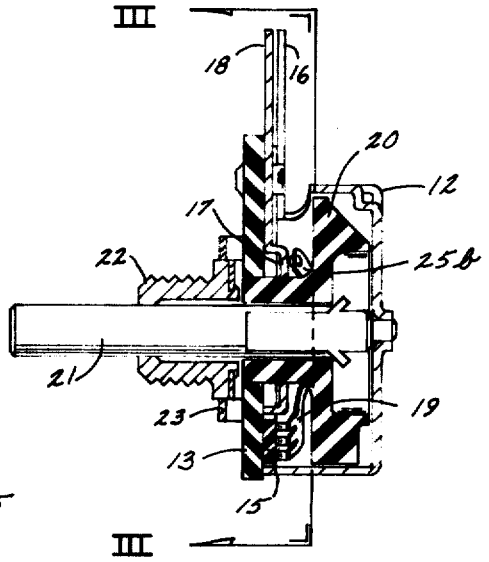
FIG. 2 is a cross sectional view on an enlarged scale taken along the line II—II of FIG. 1.
Figure 5:
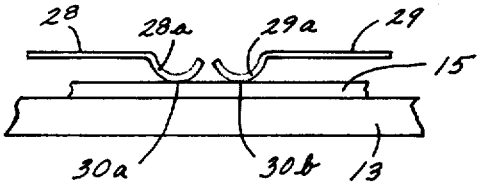
FIG. 5 is a fragmentary side view of the contactor shown in FIG. 3.
Figure 4:
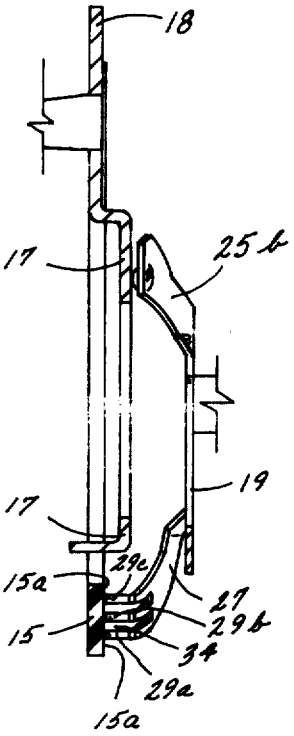
FIG. 4 is a slightly enlarged view of the contactor as shown in FIG. 2 wipably engaging the resistance element and the collector.
Figure 3:
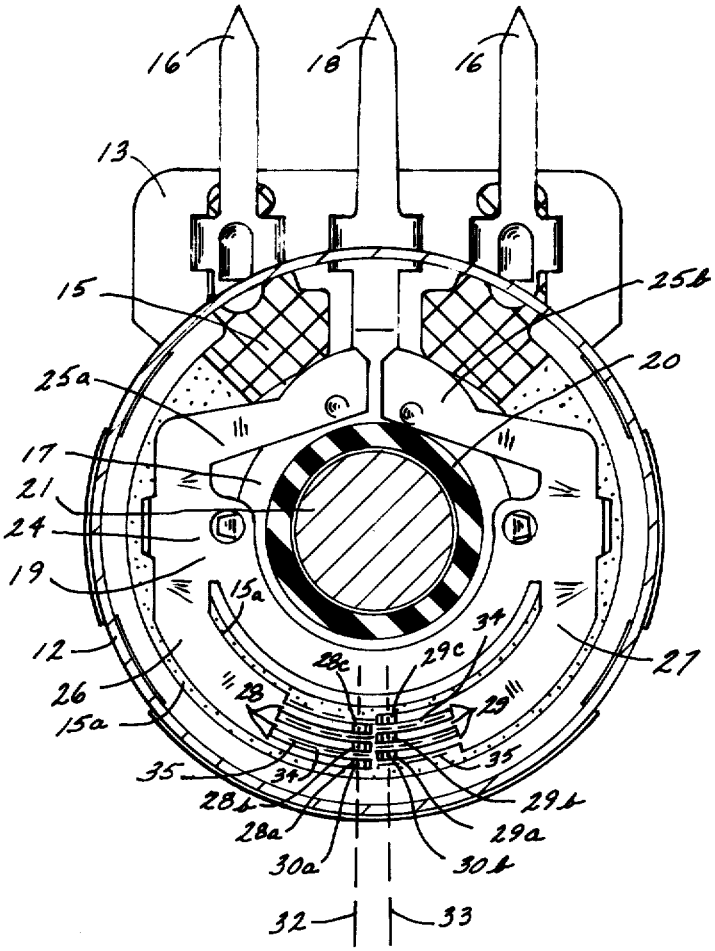
FIG. 3 is a sectional view on an enlarged scale taken along line III—III of FIG. 2.

Referring now to FIGS. 1-3 of the drawings, there is illustrated a variable resistance control generally indicated at 11 comprising a cup-shaped housing 12 having a base 13 of suitable electrically nonconductive material closing the open end of the housing. The base 13 is fixedly secured to the housing 12 with a plurality of ears 14 folded over the outer surface of the base 13. Means defining an arcuate resistance element 15 is suitably bonded or mechanically secured to the inner surface of the base 13 and the ends of the resistance element 15 are connected to a pair of terminals 16. When a not-shown wirewound resistance element is employed instead of a carbon film resistance element, it is insulatedly disposed in the housing 12 in a manner well known in the art. A collector 17 in the form of a ring mounted on the base 13 in spaced relationship to the resistance element 15 is provided with a center terminal 18 and a contactor 19 electrically connects the resistance element 15 to the collector 17.

A driver 20 is constrained to move with a control actuating means 21. In the present embodiment of the invention, the control is of the rotatable type, therefore, the control actuating means 21 is a rotatable member such as a shaft. The control also can be of the rectilinear type, i.e., having an actuating means movable in a straight line. In the present invention, the shaft 21 extends through a threaded bushing 22 secured to the base 13 and the housing 12. The contactor 19 is secured to the driver 20 and therefore, constrained to rotate therewith for wiping contact with the resistance element 15 and the collector 17. The control 11 is usually mounted to a not-shown mounting panel with the shaft 21 extending through an opening provided in the panel by securing a fastener such as a nut to the bushing 22 rotatably supporting the shaft. The threaded bushing 22 is fixedly secured to a ground plate 23 butting against the outer surface of the base 13 and secured to the housing 12 by means of the folded ears 14.

Considering now the contactor 19, it is generally semicircular in shape and is formed from a sheet of resilient metal such as spring brass. The contactor 19 comprises a semicircular body portion 24, and a pair of upper arms **25*a*, 25*b* extending from opposite sides of the body portion 24 converging toward each other and wipably engaging the collector 17. Also extending from opposite sides of the body portion 24 are a pair of lower arms 26, 27 converging toward each other. Preferably and in accord with the present invention, a plurality of fingers 28, 29 extend outwardly from each of the lower arms 26, 27 and are biased against the resistance element 15 by the resiliency of the contactor 19. Specifically, each of the fingers 28, 29 is provided with a contact 28*a*, 28*b*, 28*c* and 29*a*, 29*b*, 29*c* wipably engaging the resistance element 15. Each of the arms 25*a*, 25*b*, 26, 27 is preformed at an angle to the plane of the body potion 24. Contact pressure between the arms and the resistance element and collector is obtained by maintaining the contactor under spring tension. The contacts 28*a*, 28*b*, 28*c* and 29*a*, 29*b*, 29*c* are arcuately formed toward the resistance element 15** and in tangential engagement therewith.

In a preferred form of the invention, the fingers 28, 29 of opposing arms are staggered with respect to each other to assure that each of the paths of engagement 35 of the contacts **28*a*, 28*b*, 28*c* and 29*a*, 29*b*, 29*c* with the resistance element 15 forms an individual track. The staggered relationship of the paths of engagement 35 on the resistance element 15 reduces wear of the resistance element 15** and hence provides a longer life for the variable resistance control. In addition to providing longer life, the staggered pattern of the fingers permits closer spacing between opposing fingers.

Each of the contacts respectively engages the surface of the resistance element 15 at a contacting point, e.g., points **30*a* and 31*a* respectively for contacts 28*a* and 29*a*. The plurality of contacting points for each lower arm 26, 27 lie in a pair of closely spaced planes 32, 33 defining a line on the resistance element 15 generally transverse to the length thereof. The distance between the pair of planes 32, 33 preferably should be as small as possible and limited only by the mechanical configuration of the opposing fingers of each arm 26, 27, i.e., the fingers must not touch each other. Based on tests conducted with contactors having various spaced opposing fingers, it is preferable for the majority of applications to maintain the distance between the planes 32, 33 less than the total distance between centers of the fingers most remote on one of the arms and not to exceed 10 percent of the length of the resistance element 15 wiped by the contactor. Preferably, the fingers of each of the lower arms 26, 27 are spaced over the entire width of the resistance element 15, therefore, twice the total width of the fingers including the spacing therebetween exceeds the width of the resistance element 15. A narrow noncontacting border 15*a* disposed at the inner and outer periphery of the resistance element 15 compensates for production tolerances of the resistance element 15 and misalignment of the parts. In accord with the present invention, the number of resilient fingers 26, 27 can be doubled while still maintaining the structural integrity of the fingers thereby decreasing the contact noise by approximately fifty percent. In addition to maintaining the preferred width of the fingers 26, 27, the original spacings between the fingers can also be maintained. Maintaining the same width of the spacing 34** as in prior art contactors permits reliable production tooling with standard low cost cutting members obviating the need to reduce the size of the tool cutting members and thus reduce the mechanical strength thereof, a requirement which would either materially decrease the life of the tool or require the use of expensive alloys.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A variable resistance control comprising a base having a first surface, an arcuate resistance element carried by the first surface and provided with at least one terminal for connection to an external circuit, a collector in spaced relationship to the resistance element and provided with a terminal for connection to an external circuit, a contactor wipably engaging the resistance element and the collector and providing an electrical connection therebetween, and means for rotating the contactor, the contactor comprising a body portion, a pair of arms extending outwardly from sides of the body portion and converging toward each other, a plurality of fingers integral with each of the arms, the fingers of one of the arms being in opposing relationship to the fingers of the other of the arms, a contact projecting from each of the fingers and wipably engaging the resistance element along a path intermediate the ends thereof, the contacts projecting from the fingers of one of the arms lying in a first plane generally transverse to the length of the resistance element, the contacts projecting from the fingers of the other of the arms lying in a second plane generally transverse to the length of the resistance element, the contacts projecting from the fingers of one of the arms being closer to one of the ends of the resistance than the contacts projecting from the fingers of the other of the arms, the first plane being spaced from the second plane a distance less than ten percent of the distance intermediate the ends of the resistance element.

2. The control of claim 1, wherein the first plane is spaced from the second plane a distance less than two percent of the distance intermediate the ends of the resistance element.

3. The control of claim 1, wherein each of the fingers of one of the arms is in staggered relationship with each of the fingers of the other of the arms.

4. In a variable resistance control comprising a resistance element having a length, a collector spaced from the resistance element, a contactor wipably engaging the resistance element and the collector and providing electrical contact therebetween, the contactor comprising a body, a first pair of fingers extending from the body, a first contact extending from each of the fingers of the first pair and wipably engaging the resistance element along a pair of first paths, a second pair of fingers extending from the body, and a second contact extending from each of the fingers of the second pair and wipably engaging the resistance element along a pair of second paths, each of the first paths being in staggered relationship with each of the second paths, the first contacts lying in a first plane generally transverse to the length of the resistance element, the second contacts lying in a second plane generally transverse to the length of the resistance element, the first pair of fingers being adjacent to the second pair of fingers lengthwise of the resistance element, the first plane being spaced from the second plane a distance greater than zero percent but less than ten percent of the length of the resistance element, and means for moving the contactor along the resistance element and the collector.

5. A variable resistance control comprising a resistance element having length, a collector spaced from the resistance element, a contactor wipably engaging the resistance element and the collector and providing electrical contact therebetween, the contactor comprising a body, a first arm and a second arm extending outwardly from opposite sides of the body and converging toward each other, a first pair of fingers extending from the first arm, a first contact extending from each of the fingers of the first pair and wipably engaging the resistance element along a pair of first paths, a second pair of fingers extending from the second arm, and a second contact extending from each of the fingers of the second pair and wipably engaging the resistance element along a pair of second paths, the first contacts lying in a first plane generally transverse to the length of the resistance element, the second contacts lying in a second plane generally transverse to the length of the resistance element, the first pair of fingers being adjacent to the second pair of fingers lengthwise of the resistance element, the first plane being spaced from the second plane a distance greater than zero percent but less than ten percent of the length of the resistance element, and means for moving the contactor along the resistance element and the collector.

6. The control of claim 4, wherein the first plane is spaced from the second plane a distance less than two percent of the length of the resistance element.

7. In a variable resistance control having a resistance element, a collector in spaced relationship to the resistance element, an electrically conductive contactor engaging the resistance element and the collector, means for moving the contactor intermediate the ends of the resistance element, said contactor comprising a body portion, a first arm and a second arm extending outwardly from opposite sides of the body portion and converging toward each other, a plurality of contact fingers connected to each of the arms, a first contact carried by each of the fingers connected to the first arm and wipably engaging the resistance element, a second contact carried by each of the fingers connected to the second arm and wipably engaging the resistance element, each of the first contacts being in a predetermined arrangement to each of the second contacts, the distance between the center of the first contact and the center of the corresponding second contact being greater than zero and less than the distance between the centers of the two most remote of the first contacts, and means for connecting the resistance element and the collector into an electrical circuit.

8. The control of claim 7, wherein the first contacts are in staggered relationship to the second contacts and each contact has a separate path of engagement with the resistance element.

9. The control of claim 7 wherein the total width of the fingers connected to one of the arms including the spacings between the fingers is less than the width of the resistance element and wherein twice the total width of the fingers connected to one of the arms including the spacings between the fingers is greater than the width of the resistance element.

* * * * *